United States Patent [19]

Maxwell, Jr. et al.

[11] Patent Number: 4,823,589

[45] Date of Patent: Apr. 25, 1989

[54] AUTOMOTIVE FRAME STRAIGHTENING APPARATUS AND METHOD

[75] Inventors: Douglas C. Maxwell, Jr., San Mateo, Calif.; Walter D. Whitney, deceased, late of San Mateo, Calif., by Douglas C. Maxwell, Jr., executor

[73] Assignee: Whitney Equipment Sales, Inc., San Carlos, Calif.

[21] Appl. No.: 188,732

[22] Filed: Apr. 29, 1988

Related U.S. Application Data

[63] Continuation of Ser. No. 917,778, Oct. 10, 1986, abandoned.

[51] Int. Cl.[4] ..... B21D 01/12

[52] U.S. Cl. ..... 72/457; 72/705; 187/8.71

[58] Field of Search ..... 72/457, 705; 187/8.71; 254/9 R, 9 C; 280/43.23

[56] References Cited

U.S. PATENT DOCUMENTS

| | | | |
|---|---|---|---|
| 2,297,992 | 10/1942 | Swim | 254/9 R |
| 2,634,788 | 4/1953 | Harteker et al. | 280/43.23 |
| 3,544,127 | 12/1970 | Dobson | 280/43.17 |
| 4,510,790 | 4/1985 | Hare | 72/705 |
| 4,519,236 | 5/1985 | Celette | 72/705 |
| 4,542,636 | 9/1985 | Wright | 72/705 |
| 4,574,614 | 3/1986 | Field | 72/705 |
| 4,592,225 | 6/1986 | Eck | 72/705 |

FOREIGN PATENT DOCUMENTS

| | | | |
|---|---|---|---|
| 2420248 | 11/1975 | Fed. Rep. of Germany | 72/705 |
| 1361170 | 7/1974 | United Kingdom | 72/705 |

*Primary Examiner*—Lowell A. Larson

*Attorney, Agent, or Firm*—Flehr, Hohbach, Test, Albritton & Herbert

[57] ABSTRACT

Apparatus and method for straightening the bodies and frames of automobiles and other vehicles. The apparatus includes a bench having a low profile with retractable lifts which permit the bench to be positioned substantially flat on the ground so that a vehicle can be driven over it. The vehicle can then be raised and lowered with the bench, as required. The vehicle is secured to the bench, and a puller which can be adjusted about both horizontal and vertical axes is connected to the bench and the vehicle for pulling on desired portions of the vehicle. Both the puller and the means for securing the vehicle to the bench are attached to the bench with wedges which enable them to be removed and repositioned, as required.

16 Claims, 4 Drawing Sheets

AUTOMOTIVE FRAME STRAIGHTENING APPARATUS AND METHOD

This is a continuation of application Ser. No. 917,778 filed Oct. 10, 1986, now abandoned.

This application pertains generally to automotive repair equipment, and more particularly to apparatus and a method for straightening the body and frame of an automobile for a vehicle.

Many automotive frames straightening machines heretofore provided require that the vehicle be lifted and set down onto the machine. Other such machines tilt or have ramps by which the vehicle can be drawn or pulled onto the machine. All of these machines have certain limitations and disadvantages in that they require the vehicle to raised above the ground to get it onto the machine.

Frame straightening machines generally also have pulling towers with chains or cables which are connected to the portions of the vehicle to be pulled. These pulling towers are relatively inflexible and it is often necessary to employ pulleys or other external means to apply the pull in the desired direction to a given portion of the vehicle.

It is in general an object of the invention to provide a new and improved apparatus and method for the straightening of the frames and bodies of automobiles and other vehicles.

Another object of the invention is to provide an apparatus and a method of the above character which overcome the limitations and disadvantages of straightening equipment heretofore provided.

Another object of the invention is to provide an apparatus and a method of the above character which are easy to use and can be utilized by one man.

These and other objects are achieved in accordance with the invention by providing frame and body straightening apparatus having a low profile bench with retractable lifts which permit the bench to be positioned substantially flat on the ground so that a vehicle can be driven over it. The vehicle can then be raised and lowered with the bench, as required. The vehicle is secured to the body, and a puller which can be adjusted at both horizontal and vertical axis is connected to the bench and to the vehicle for pulling on desired portions of the vehicle. Both the puller and the means for securing the vehicle to the bench are affixed to the bench with wedges which enable them to be removed and repositioned, as required.

Figure 1:
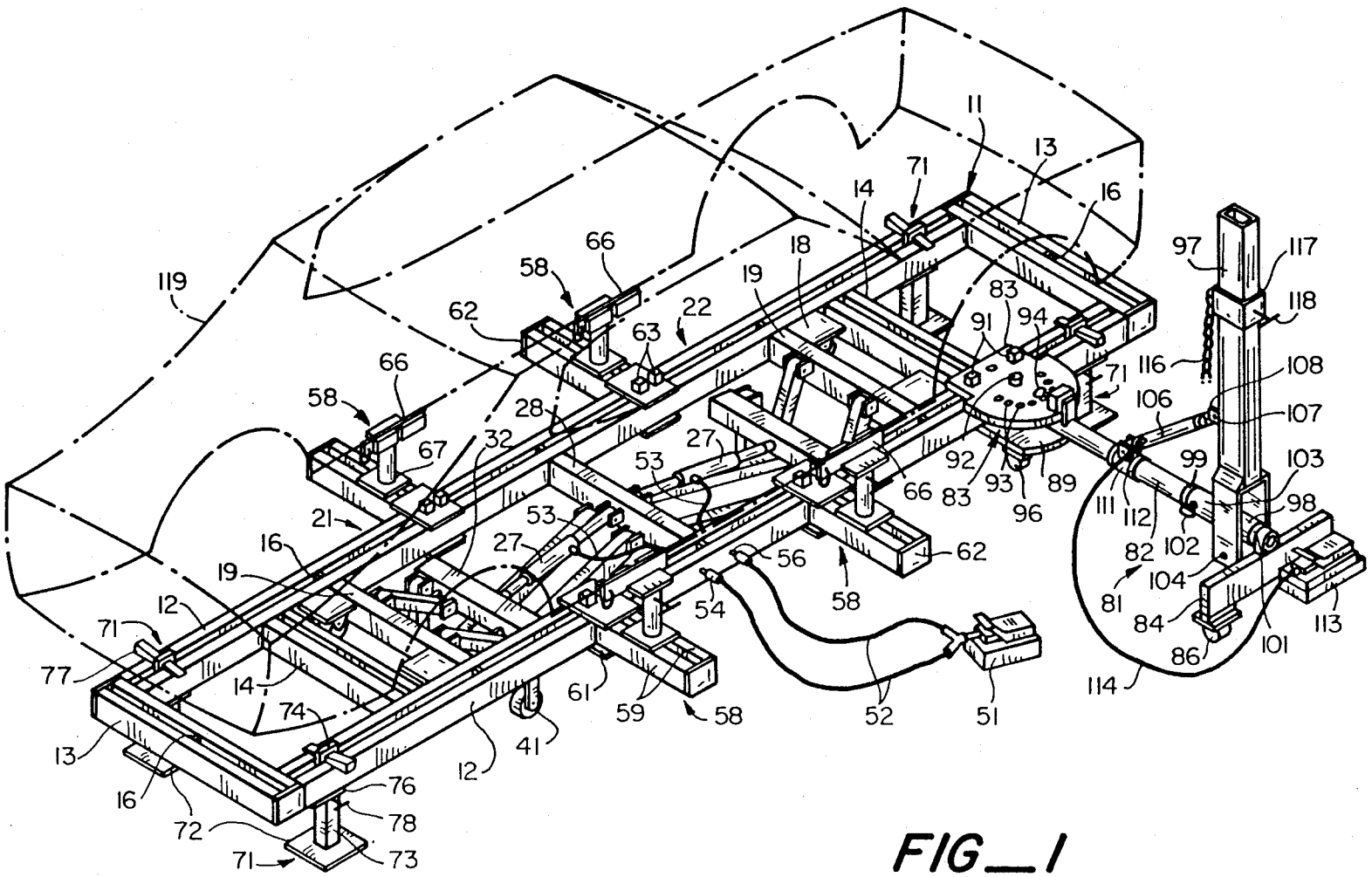
FIG. 1 is an isometric view of one embodiment of automotive frame straightening apparatus according to the invention.
Figure 2:
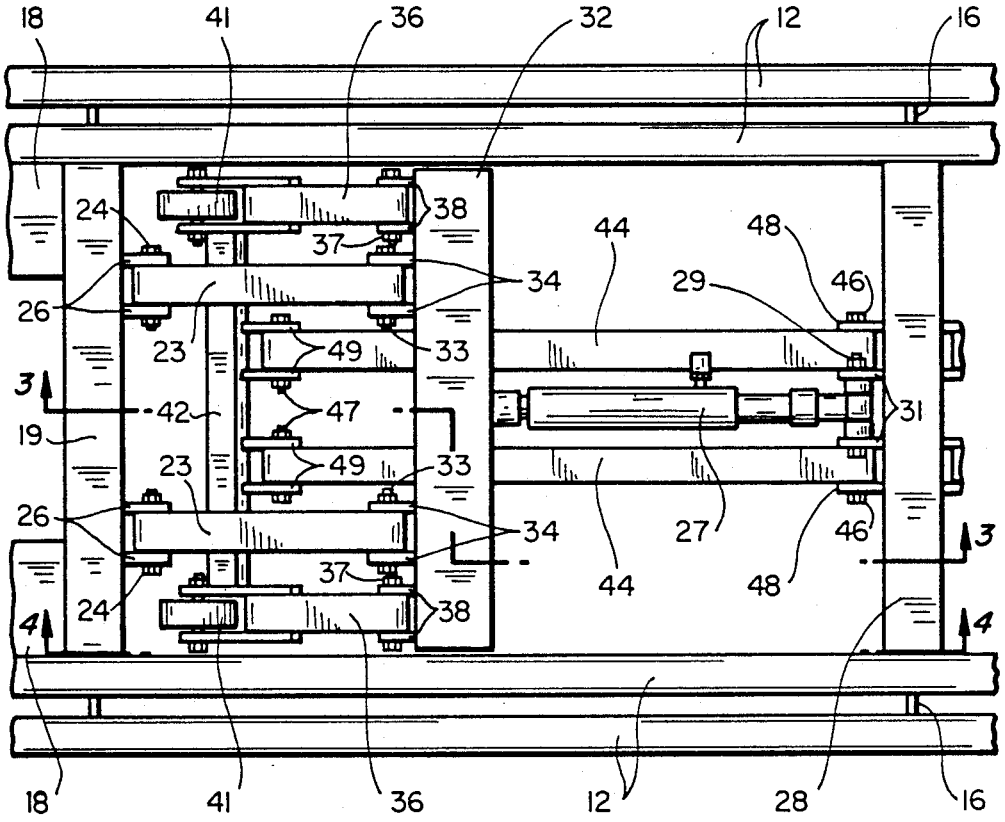
FIG. 2 is a fragmentary top plan view of the embodiment of FIG. 1 illustrating one of the bench raising lifts in its retracted position.

As illustrated in the drawings, the frame straightening apparatus comprises a generally rectangular bench 11 having side rails 12 and end rails 13 along opposite sides thereof and cross rails 14 between the side rails near the end rails. Each of these rails comprises of a pair of rigid, horizontally ending members such as box tubing spaced laterally apart by a distance on the order of one inch. The rail members are welded together to form a rigid unitary structure, with spacers 16 being welded between the members at suitable intervals. Ground-engaging wheels 17 are mounted on plates 18 affixed to side rails 12 and to cross members 19 for supporting the bench on the ground when it is in a lowered position. Throughout this specification, the term 'ground' is used generically to designate a floor or other suitable surface for supporting the apparatus.

Means is provided for moving the bench between raised and lowered positions. This means includes a pair of hydraulically actuated scissor lifts 21, 22 carried by the bench for engagement with the ground. Each of the lifts includes a pair of swing arms 23, each of which is pivotally connected at one end to the cross members 19 by a bolt 24 and a pair of flanges 26 affixed to the cross member. A hydraulically actuated ram 27 is pivotally connected at one end to a central cross member 28 by a bolt 29 and a pair of flanges 31 affixed to the cross member. The second end of the ram is connected to a floating pivot head 32 which extends transversely of the bench between side rails 12. The second end of each of the side arms 23 is pivotably connected to the pivot head by a bolt 33 and a pair of flanges 34 affixed to the pivot head.

A second pair of side arms 36 are pivotally connected to pivot head 32 by bolts 37 and flanges 38 affixed to the pivot head. Ground engaging wheels 41 are rotatively mounted at the free ends of arms 36, and a cross bar 42 is rigidly connected between free ends of the these arms. A pair of connecting rods or links 44 are pivotally connected between central cross member 28 and cross bar 42 by bolts 46, 47 and flanges 48, 49 affixed to the cross member and the cross bar respectively.

Pressurized hydraulic fluid is applied to rams 27 from a source 51 through lines 52, 53. Lines 52 are connected to the source and are provided with connectors 54 which mate with hydraulic fittings 56 mounted on one of the side rails 12. Lines 53 extend between rams 27 and fittings 56. These lines pass through sleeves (not shown) which extend through bore holes (not shown) in the two rail members. These sleeves serve to protect the lines and to strengthen the rail structure.

Figure 3:
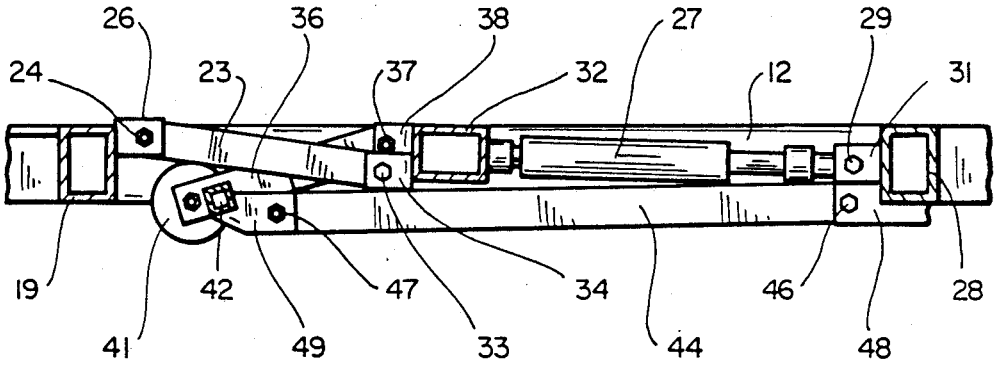
FIG. 3 is a cross-sectional view taken along line 3—3 in FIG. 2, illustrating the lift in its retracted position.
Figure 4:
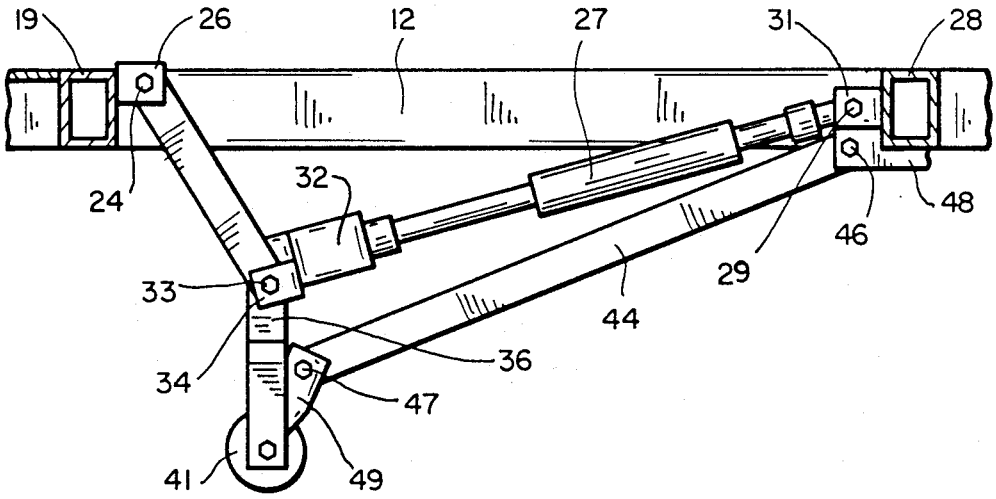
FIG. 4 is a cross-sectional view taken along line 4—4 in FIG. 2, illustrating the lift in an extended position.

In operation, each of the rams 27 is movable between a retracted position illustrated in FIG. 3 and an extended position illustrated in FIG. 4. In the retracted position, the lift is collapsed or folded substantially within the plane of the bench, with no portion of the lift extending below the wheels 17 of the bench. In this position, rams 27, arms 23, 36 and connecting rods 44 all extend in a generally horizontal direction between the side rails of the bench, and lift wheels 41 are retracted above bench wheels 17. The extension of the rams causes arms 23 and pivot heads 32 to swing downwardly from the bench. As this happens, links 44 cause arms 36 to swing down to a generally vertical position, with wheels 41 bearing against the ground to lift the bench.

It will be noted that the bench has a very low profile and that when lifts 21, 22 are retracted, they do not project substantially above or below the rail members of the bench. When the bench is in its lowered position, it lies very close to the ground, and a automobile or other vehicle is easily driven or rolled over it.

Laterally extending cross arms 58 are mounted on side rails 12 and project outwardly therefrom. Each of the cross arms comprises a pair of horizontally extending, spaced apart rigid members 59 secured together at their inner ends by horizontal flanges or plates 61 and at their outer ends by plates 62. Plates 61 project beyond the inner ends of arm members 59, and they are spaced apart by a distance corresponding to the height of rails 12. Wedges 63 extend through aligned openings in plates 61 and pass between the rail members to secure the cross arms to the rails. This method of mounting enables the cross arms to be installed and removed easily, and it permits them to be mounted in any desired position on the bench. Although the cross arms are illustrated as being mounted on side rails 12, one or more of them can be installed on end rails 13 or cross rails 14, if desired.

Means is provided for securing a vehicle to the bench. In the embodiment illustrated, this means includes pinch weld clamps 66 mounted on cross arms 58. These clamps are designed specifically to engage the pinch welds on automobiles or other vehicles having unitized bodies. These clamps have base plates 67 which rest on cross arms 58 with stems (not shown) which extend between the cross arm members and wedges (not shown) which pass through cross bores in the stems on the underside of the cross arms to secure the clamps to the cross arms. The clamps can be adjusted in height, and they can be positioned as desired along the cross arms to accommodate vehicles of different width.

Press stands 71 support the bench in a raised position once it has been lifted by lifts 21, 22. Each of these stands comprises a base plate 72, a tubular outer post 73, and an inner post 74 telescopically mounted within the outer post. Post 74 passes between the rail members, and the rail members rest upon a horizontal plate 76 affixed to the inner post. The stand and the bench are secured together by a wedge 77 which passes through an opening in post 74 on the upper side of the rail members. The height of the stands is adjustable, with pins 78 passing through openings in the inner and outer posts to set the stands at different heights.

A puller 81 is connected to bench 11 for exerting a pull on the body or frame of a vehicle mounted on the bench. The puller includes a horizontally extended beam 82 of circular cross section. At its inner end, beam 82 is supported by a swivel head 83 which is secured to one of the peripheral bench rails. The outer end of beam 82 is supported by a base comprising a cross arm 84 to which the beam is rigidly affixed with ground engaging wheels 86 on the underside of the cross arm.

Swivel head 83 comprises a pair of horizontal plates 88, 89 which are secured to the bench rail by means of wedges 91 which extend through aligned openings in the plates and pass between the rail members. The inner end of beam 82 is pivotally connected to plates 88, 89 and by a bolt or pin 92 for rotational movement about a vertically extending axis. Aligned openings 93 are spaced along an arcuate path in plates 88, 89, and a pin 94 can be inserted through these openings and an opening (not shown) in beam 82 to secure the beam in any desired angular position about the axis. Wheels 96 are mounted on lower plate 89 for engagement with the ground to permit the puller to be rolled about when it is not connected to the bench.

A post 97 is mounted on beam 82 toward the outer end of the beam for rotational movement about the beam axis. The post includes a cylindrical sleeve 98 which is rotatably mounted on beam 82 between a pair of stationary collars 99, 101 which are affixed to the beam. The post can be secured in a desired rotational position by means of a pin 102 inserted through openings 103 in the sleeve and beam.

The lower end of post 97 is pivotally connected to sleeve 98 by a pin 104 which permits tilting movement of the post relative to the beam. A hydraulically actuated ram 106 is connected between the post and the beam. One end of the ram is pivotally connected to the post by a pin 107 and flanges 108, and the other end of the ram is pivotally connected to a sleeve 111 which is rotatably mounted on the beam between a pair of stationary collars 112 affixed to the beam. Pressurized hydraulic fluid is supplied to the ram from a source 113 through a line 114.

A chain or cable 116 is provided for exerting a pull on the desired portion of the vehicle. One end of the chain is connected to a collar 117 which is slidably mounted on post 97 and secured in a desired position by clamp screw 118. The other end of the chain can be connected to the vehicle by any suitable means.

Figure 5:
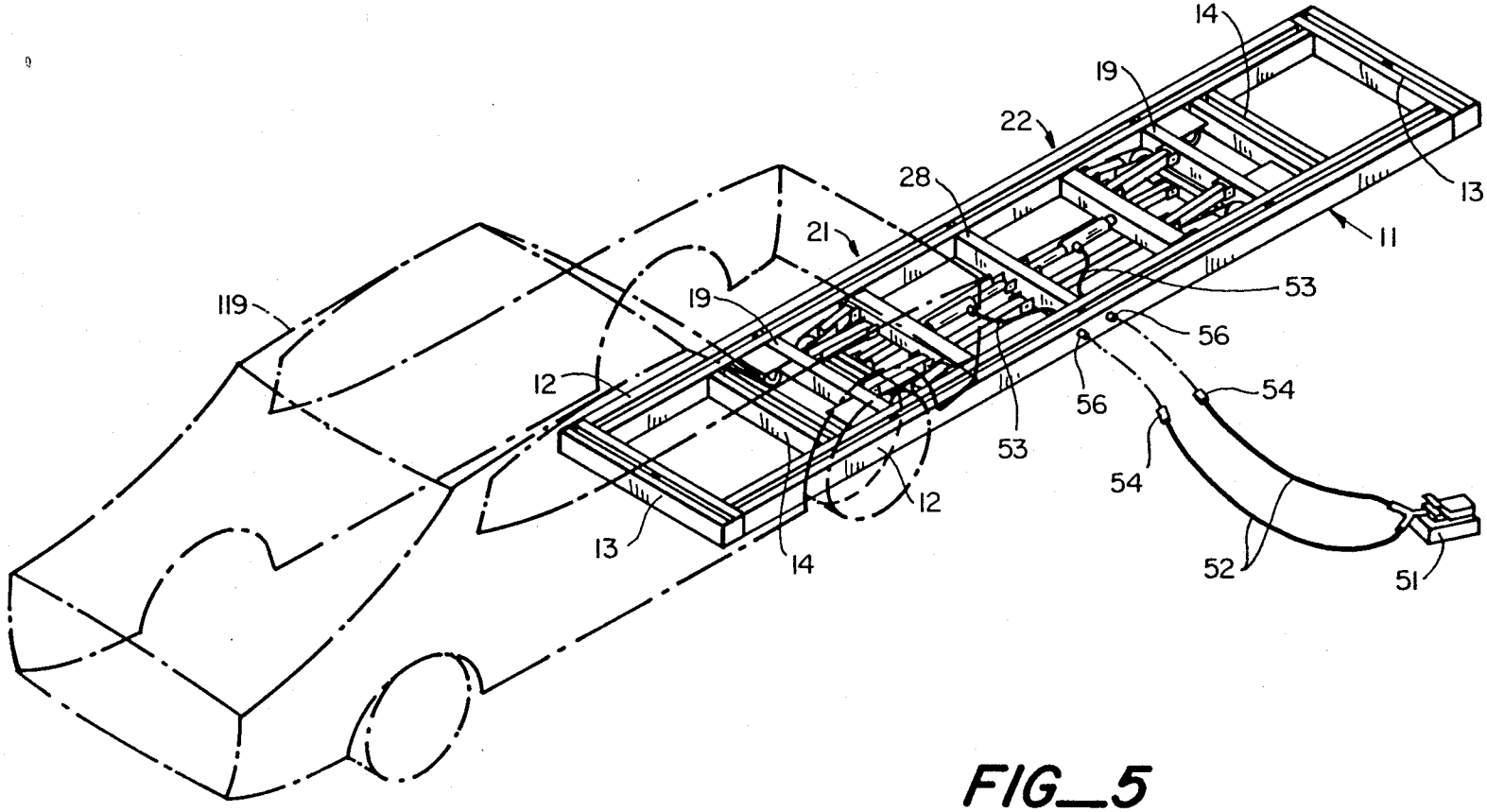
FIG. 5 is an isometric view of the bench of the embodiment of FIG. 1 in a retracted or rest position with a vehicle being driven over the bench.

Operation and use of the straightening apparatus, and therein the method of the invention are as follows. As illustrated in FIG. 5, the bench is positioned flat on the ground, and hydraulic lines 52 are disconnected from fittings 56. The vehicle to be straightened is driven over the bench to the desired position. Lines 52 are reconnected, and source 51 is actuated to operate lifts 21, 22 to raise the bench and the vehicle off the ground. Wheel stands (not shown) are then placed beneath the wheels of the vehicle, and the bench is lowered until the vehicle rests on these stands and the bench is clear of the vehicle. Cross bars 58 are then mounted on the bench, and pinch weld clamps 66 are installed on the cross bars. The clamps are positioned to engage the pinch welds of the vehicle, the bench is raised, and the clamps are tightened onto the pinch welds to secure the vehicle to the bench. Press stands 71 are then installed, and the bench is lowered until it rests upon them.

Puller 81 is then mounted to the bench, and the positions of beam 82 and post 97 about the vertical and horizontal axes are set to provide a pull from the desired direction. Chain 116 is connected to the portion of the vehicle to be pulled, and ram 106 is actuated to exert the desired pull on the vehicle.

The invention has a number of important features and advantages. The low profile of the bench and the collapsible nature of the scissor lifts enable the bench to positioned close to the floor where a vehicle can be driven or rolled over it. The puller can be positioned and adjusted to provide a pull from any desired direction, and the use of wedges for mounting the cross arms stands an d puller makes them easy to install and remove.

It is apparent from the foregoing that a new and improved automotive frame straightening apparatus and method have been provided. While only certain presently preferred embodiments have been described in detail, as will be apparent to those familiar with the art, certain changes and modifications can be made without departing from the scope of the invention as defined by the following claims.

What is claimed is:

1. In apparatus for straightening the body/frame of a vehicle: a generally planar bench having a low profile which permits the vehicle to be driven over the bench when the bench is in a lowered position and resting substantially horizontally on the ground, means for securing the vehicle to the bench, a puller connected to the bench and engageable with the body/frame of the vehicle for pulling on the same, and a plurality of scissor lifts carried by the bench and engageable with the ground for moving the bench between the lowered position and a raised position, each of said scissor lifts having an upper arm and a lower arm connected pivotally together, means pivotally connecting the upper arm to the bench, a ground engaging wheel carried by the lower arm, a link pivotally connected between the bench and the lower arm, and an actuator connected between the bench and the arms for moving the arms between a collapsed position in which the arms are generally parallel to each other in the plane of the bench and an extended position in which the arms extend in a generally vertical direction beneath the bench.

2. The apparatus of claim 1 wherein the puller comprises a horizontally extending beam pivotally connected to the bench for movement to different positions about a vertically extending axis, a post mounted on the beam for movement to different rotative positions about the beam, and means including an actuator connected to the post for exerting a pull on the body/frame of the vehicle.

3. The apparatus of claim 2 wherein the post is pivotably mounted on the beam for movement to different angular positions relative to the beam, and the actuator is connected between the post and the beam for moving the post to different angular positions.

4. The apparatus of claim 1 wherein the bench comprises a generally rectangular frame having horizontally extending rails on opposite side thereof, and the scissor lifts retract to a position between the rails when the bench is in the lowered position.

5. The apparatus of claim 4 wherein the means for securing the vehicle to the bench comprises clamps mounted on cross bars which extend transversely of the bench frame and are removably secured to the rails on opposite sides of the frame.

6. The apparatus of claim 4 wherein the the cross bars are secured to the rails by wedges.

7. The apparatus of claim 4 wherein the puller is removably connected to the bench by a swivel head which is secured to the rails by wedges.

8. In apparatus for straightening the body/frame of a vehicle: a generally planar bench having horizontally extending rails on opposite sides thereof, a pair of scissor lifts mounted on the bench and engageable with the ground for raising and lowering the bench, said bench having a low profile and said lifts being collapsible to a position within the profile of the bench so that the bench can be lowered to the ground and the vehicle can be driven over the bench, means mounted on the rails for securing the vehicle to the bench, and a puller connected to one of the rails and engageable with the body/frame of the vehicle for pulling on the same, each of said scissor lifts having an upper arm and a lower arm connected pivotally together, means pivotally connecting the upper arm to the bench, a ground engaging wheel carried by the lower arm, a link pivotally connected between the bench and the lower arm, and an actuator connected between the bench and the arms for moving the arms between a collapsed position in which the arms are generally parallel to each other in the plane of the bench and an extended position in which the arms extend in a generally vertical direction beneath the bench.

9. The apparatus of claim 8 wherein the means for securing the vehicle to the bench includes clamps mounted on cross bars which are removably mounted on the rails by wedges.

10. The apparatus of claim 8 wherein the puller comprises a horizontally extending beam pivotally connected to one of the rails for movement to different positions about the vertically extending axis, a post mounted on the beam for movement to different rotative positions about the beam, and means including an actuator connected to the post for exerting a pull on the body/frame of the vehicle.

11. The apparatus of claim 10 wherein the beam is pivotably connected to the rail by a swivel head which is removably secured to the rail by wedges.

12. The apparatus of claim 11 wherein the post is pivotably mounted on the beam for movement to different angular positions relative to the beam, and the actuator is connected between the post and the beam for moving the post to the different angular positions.

13. In apparatus for straightening the body/frame of a vehicle: a horizontally extending bench having a low profile for holding the vehicle, a plurality of scissor lifts carried by the bench for moving the bench between raised and lowered positions and not extending substantially above or below the bench when the bench is in the lowered position, means for securing the vehicle to the bench, a horizontally extending beam pivotally connected to the bench for movement to different positions about a vertical extending axis, a post mounted on the beam for movement to different rotative positions about the beam, and means including an actuator connected to the post for exerting a pull on the body/frame of the vehicle, each of said scissor lifts having an upper arm and a lower arm connected pivotally together, means pivotally connecting the upper arm to the bench, a ground engaging wheel carried by the lower arm, a link pivotally connected between the bench and the lower arm, and an actuator connected between the bench and the arms for moving the arms between a collapsed position in which the arms are generally parallel to each other in the plane of the bench and an extended position in which the arms extends in a generally vertical direction beneath the bench.

14. The apparatus of claim 13 wherein the post is pivotably mounted on the beam for movement to different angular positions relative to the beam, and the actuator is connected between the post and the beam for moving the post to different angular positions.

15. The apparatus of claim 13 wherein the beam is removably connected to the bench so that the vehicle can be driven over the bench when the bench is in its lowered position.

16. In a method of straightening a body/frame of a vehicle on a bench having a lift for moving the bench between raised and lowered positions, the steps of: rolling the vehicle over the bench with the bench in its lowered position with the vehicle passing freely over the bench and not being raised as it is moved over the bench, actuating the lift to raise the bench and the vehicle above the ground, positioning support stands beneath the vehicle when the bench is in a raised position, lowering the bench with the lift until the vehicle rests on the support stands and the bench is disengaged from the vehicle, installing vehicle holding clamps on the bench, raising the bench with the lift to engage the clamps with the vehicle, securing the clamps to the vehicle to secure the vehicle to the bench, connecting a puller to the bench and to the body/frame of the vehicle, and actuating the puller to exert a pull on the body/frame.

* * * * *